United States Patent [19]

Martin et al.

[11] 4,016,876

[45] Apr. 12, 1977

[54] BREATHING APPARATUS

[75] Inventors: Frank E. Martin, Chester; John R. Colston, Annapolis; Norman E. Smith, Pasadena, all of Md.

[73] Assignee: Westinghouse Electric Corporation, Pittsburgh, Pa.

[22] Filed: July 30, 1975

[21] Appl. No.: 600,751

Related U.S. Application Data

[62] Division of Ser. No. 413,413, Nov. 6, 1973, Pat. No. 3,913,576.

[52] U.S. Cl. ..... 128/142 R; 128/202

[51] Int. Cl.[2] ..... A62B 7/02; A61M 16/00

[58] Field of Search ..... 128/142–142.3, 128/145.6, 145.8, 2.07, 188, 202, 203, 195, DIG. 29, DIG. 17; 23/254 E

[56] References Cited

UNITED STATES PATENTS

| | | | |
|---|---|---|---|
| 3,613,665 | 10/1971 | Gorsuch | 128/2.07 |
| 3,694,164 | 9/1972 | Guenther | 23/254 E |
| 3,695,261 | 10/1972 | Emmons | 128/142.2 |
| 3,716,337 | 2/1973 | Jones | 23/254 E |
| 3,923,053 | 12/1975 | Jansson | 128/142 R |

OTHER PUBLICATIONS

M.I.T. Design and Construction of a New Respiratory Protective Device for Firefighters, David G. Jansson, pp. 1–13, Feb. 1973.

*Primary Examiner*—Robert W. Michell
*Assistant Examiner*—Henry J. Recla
*Attorney, Agent, or Firm*—D. Schron

[57] ABSTRACT

Breathing apparatus which incorporates a sensing device operable to adjust the amount of breather's exhaled gas captured in a gas collector section as a direct function of the carbon dioxide content of the exhalation. The amount of exhaled gas captured is sufficiently low in carbon dioxide ($CO_2$) content to permit rebreathing on the next inhalation, at which time the sensor again adjusts the volume of exhaled gas to be captured. In the one embodiment, a fire fighter's breathing system is described wherein the gas collector section is integral with the breathing mask worn by the fire fighter.

4 Claims, 10 Drawing Figures

BREATHING APPARATUS

This is a division of application Ser. No. 413,413 filed Nov. 6, 1973, now U.S. Pat. No. 3,913,576.

BACKGROUND OF THE INVENTION

1. Field of the Invention

Breathing apparatus of the type wherein the user rebreathes a portion of his previously exhaled breath.

2. Description of the Prior Art

Attempts have been made in the past to conserve the amount of breathing gas consumed from a breathing apparatus by allowing collection and subsequent rebreathing of the initial portion of exhaled gas.

This initial portion is low in carbon dioxide content and is referred to as the dead space or dead volume. Such breathing apparatus finds widespread use in the fields of diving, space, rescue work and in general, instances where the user must be supplied with breathable gas while in a hostile ambient environment.

Previous systems relied on a technique for capturing a fixed volume of exhaled gas within a distensible bag, the fixed volume being determined by maximum bag distension. The entire volume of gas captured within this bag was then made available for the next inhalation. Such systems increased the duration of the breathable gas supplied; however, in actuality, the dead volume is not a constant value nor is it a constant ratio with respect to inspiratory tidal volume. Accordingly, depending upon the fixed volume chosen, the apparatus can be less than efficient or in some instances, can be quite hazardous due to excess amounts of $CO_2$ rebreathed.

SUMMARY OF THE INVENTION

The present invention retains optimum efficiency and safety regardless of high or low work rates by variably controlling the volume of exhaled breath which is saved, in accordance with the user's breathing.

A sensing means senses the carbon dioxide content of the users exhaled breath and effectively causes a volume limiting device to proportionately limit the amount of exhaled breath flowing into a gas collector. The gas thus collected is available to supplement the next inhalation.

The gas collector may, if desired, be formed of two sections, a first section having a fixed maximum volume and a second section having a variable maximum volume.

DESCRIPTION OF THE PREFERRED EMBODIMENT

Figure 1:
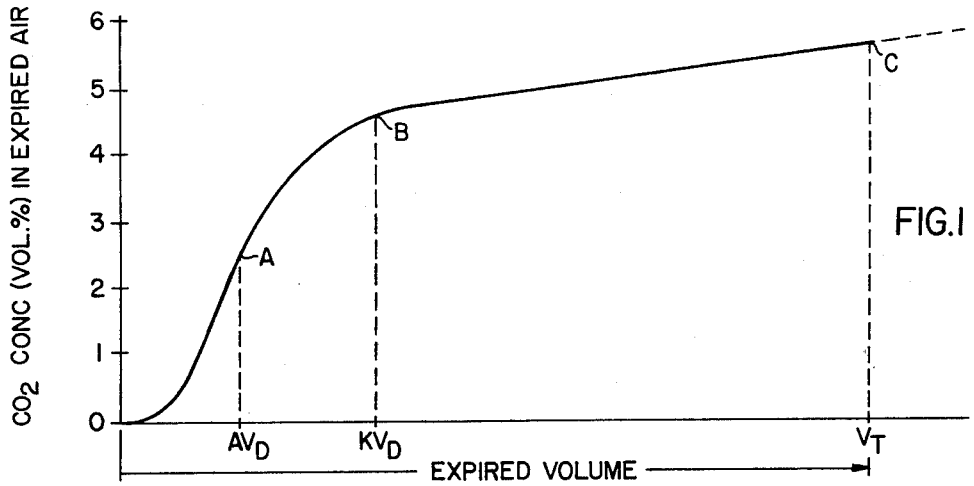
FIG. 1 is a curve illustrating the variation in $CO_2$ concentration as a function of expired volume.

FIG. 1 is a typical plot of instantaneous $CO_2$ content as a function of a volume of expired breath and serves to define certain terms. The vertical axis represents $CO_2$ concentration in the expired breath and the horizontal axis represents the expired volume. The initial expiration contains no $CO_2$ whatsoever, and thereafter, the $CO_2$ content rises. At inflection point A, the instantaneous $CO_2$ concentration is somewhat less than 2.5%; however, the cumulative $CO_2$ content up to this point is less than 1%. This volume is approximately equal to the volume of the bronchial tree and upper respiratory passages not subject to gas exchange. This volume is termed the anatomic dead volume and is designated on the horizontal axis by the term $AV_D$.

Respiratory gas exchange takes place in the alveoli of the lungs and point B on the curve represents instantaneous $CO_2$ concentrations typical of alveolar gas and is in the order of 4–4.5%. The cumulative $CO_2$ content up to point B, however, would only be about 2–2.5% and within an acceptable range for rebreathing. The volume corresponding to point B is designated the kinetic dead volume $KV_D$ and may be defined as the amount of exhaled gas needed to flush the dead space gas from the respiratory passages up to the appearance of pure alveolar gas. The kinetic dead volume is approximately equal to twice the anatomic dead volume.

Proceeding along the curve, point C is reached and represents the tidal volume, that is, the volume of gas expired during the respiratory cycle, and is designated $V_T$.

Figure 2:
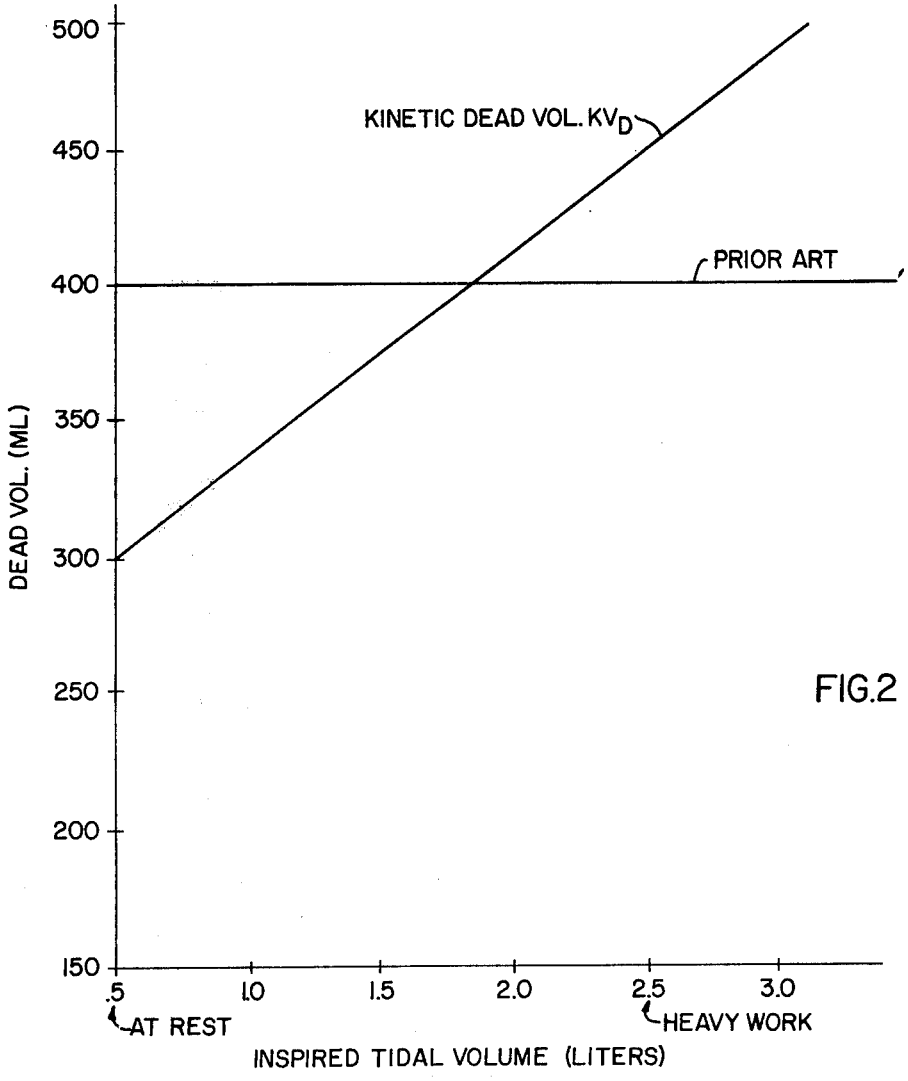
FIG. 2 is a curve illustrating the dead volume as a function of inspired tidal volume.

As total lung volume increases due to increased depth of inspiration, so also does the dead volume increase. A typical relationship is illustrated in FIG. 2 wherein the vertical axis represents the kinetic dead volume in milliliters and the horizontal axis represents the inspired tidal volume in liters. The sloped straight line curve of FIG. 2 intersects the vertical axis at 300 milliliters and has a slope of approximately 7.5 milliliters increase in kinetic dead volume per 100 milliliter increase in tidal volume. The actual slope of the straight line varies somewhat, according to different investigators in the field of respiratory physiology and according to recent data, FIG. 2 represents a somewhat conservative viewpoint. That is, the curve in FIG. 2 is less steep than that predicted by some investigators. In addition, the typical curve is based on an atrest anatomic dead volume of 150 milliliters (the kinetic dead volume is approximately twice that or 300 milliliters) corresponding approximately to a user's body weight of 150 lbs. The base value varies per individual roughly on a direct milliliter of anatomic dead volume per pound of body weight basis.

Various prior art devices utilize a fixed maximum volume breath-saving arrangement. Let it be assumed for purposes of comparison, that the breath-saving volume is designed to hold a maximum capacity of 400 milliliters of exhaled breath; this is represented by the horizontal line in FIG. 2 labeled "Prior Art". If the user is working at a rate such that his inspired tidal volume is a little more than 1.8 liters, then from the kinetic dead volume curve it is seen that there is 400 milliliters of dead volume containing gas which can be rebreathed and, accordingly, the apparatus is efficient for that particular work rate.

Consider now a situation where the user is at rest. In such instance, his kinetic dead volume is only 300 milliliters, but he is still collecting 400 milliliters of exhaled gas; and thus an unsafe and potentially dangerous condition exists whereby the user will be rebreathing saved gas having a $CO_2$ content above an established safe maximum. Consider now the other extreme, where the user is doing heavy work such that his inspired tidal volume is around 2.5 liters. In that instance, his kinetic dead volume will be in the order of 450 milliliters, yet his apparatus is sized to only collect 400 milliliters, representing a less than efficient operation. To eliminate any potential hazard, the fixed maximum volume may be reduced to, for example, 300 milliliters; however, the apparatus will always be less than efficient for all situations except when the user is at rest.

The apparatus of the present invention is constructed and arranged such that an amount of exhaled gas is collected which closely approximates the kinetic dead volume curve, ideally to track right on it, or practically, to operate in a zone right below it. Thus, when the user is at rest an exhaled volume close to 300 milliliters will be captured, and this volume will increase as the work rate and, accordingly, the inspired tidal volume increases to retain the optimum combination of efficiency and safety regardless of high or low work rates.

Figure 3A:
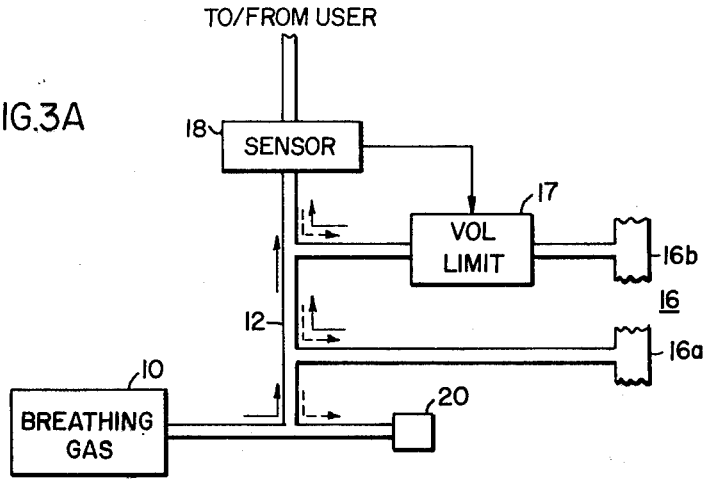
FIGS. 3A and 3B illustrate, in block diagram form, two embodiments of the present invention.

One way of accomplishing this variable volume collection of exhaled gas is illustrated in FIG. 3A in block diagram form. A source of breathing gas 10 provides oxygen-containing gas to the user via passageway 12, on demand, and at the ambient pressure. Exhaled gas from the user passes to a gas collector means 16 which may be a flexible bellows arrangement and may, if desired, be constructed in two sections — a first section 16*a* having a fixed maximum volume and a second section 16*b* having a variable maximum volume and which closes as determined by a volume limiting device 17. The section 16*a* may have a volumetric capacity equivalent to the at-rest dead volume of the user and the volumetric capacity of section 16*b* may be such as to accommodate the expected remainder of the kinetic dead volume.

The volume limiting device 17 operates in response to a sensor means 18 disposed relative to passageway 12 to sense the flow rate and volume of an inspired breath to close the volume limiting device at the proper time.

Inhaled gas in FIG. 3A is designated by the solid line arrows and exhaled gas by the dotted line arrows. After the volume limiting device has closed the gas collector 16 in response to a signal from the sensor 18, further exhaled gas is discharged to the ambient medium through a relief valve 20.

Figure 3B:
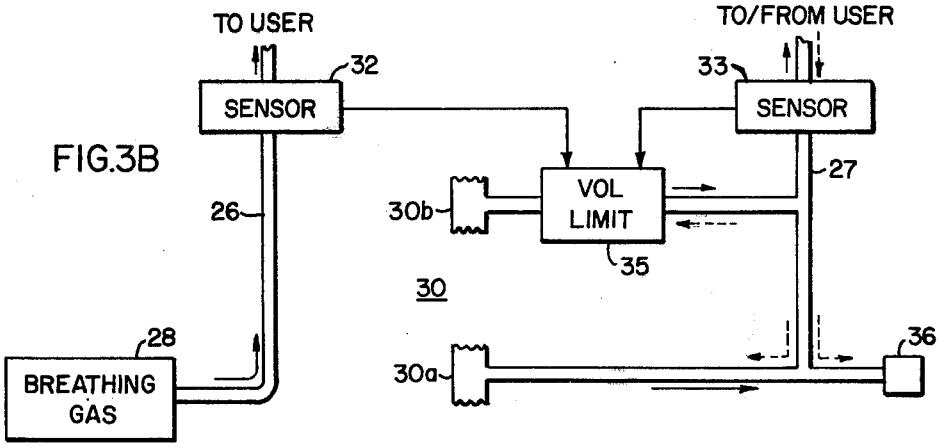

For some operations, it may be desired to maintain the breathing gas from the source in a dry condition so as to be useful for defogging purposes. By way of example, FIG. 3B illustrates an arrangement for accomplishing this with the provision of two separate passageways, the inhalation passageway 26 and exhalation passageway 27. A source of breathing gas 28 provides the oxygen-containing gas to the user who also breathes previously collected gas from the gas collector 30 which may, as previously discussed, be comprised of a first section 30*a* having a fixed maximum volume and a second section 30*b* having a variable maximum volume. Sensors 32 and 33 sense the flow rate and volume of inhaled gases in respective passageways 26 and 27 to open the volume limiting device 35 to enable section 30*b* to capture exhaled gas over and above that captured by section 30*a*. The remainder of the exhaled gas is discharged to the ambient medium by way of relief valve 36.

For the fluidic embodiments of the invention, an indication of the inspired tidal volume can be obtained by a measurement of the inspiration flow rate over the inhalation period. For very slow breathing or in instances where the user may hold his breath, there is the possibility of alveolar and dead volume gases mixing within the respiratory passages, and the exhaled breath would not be $CO_2$ free. Accordingly, it is preferably that means be provided to initiate closing off of the variable volume gas collector, should this type of breathing occur. That is, the amount of exhaled gas captured decreases as a function of the time from inhalation to exhalation.

Figure 4:
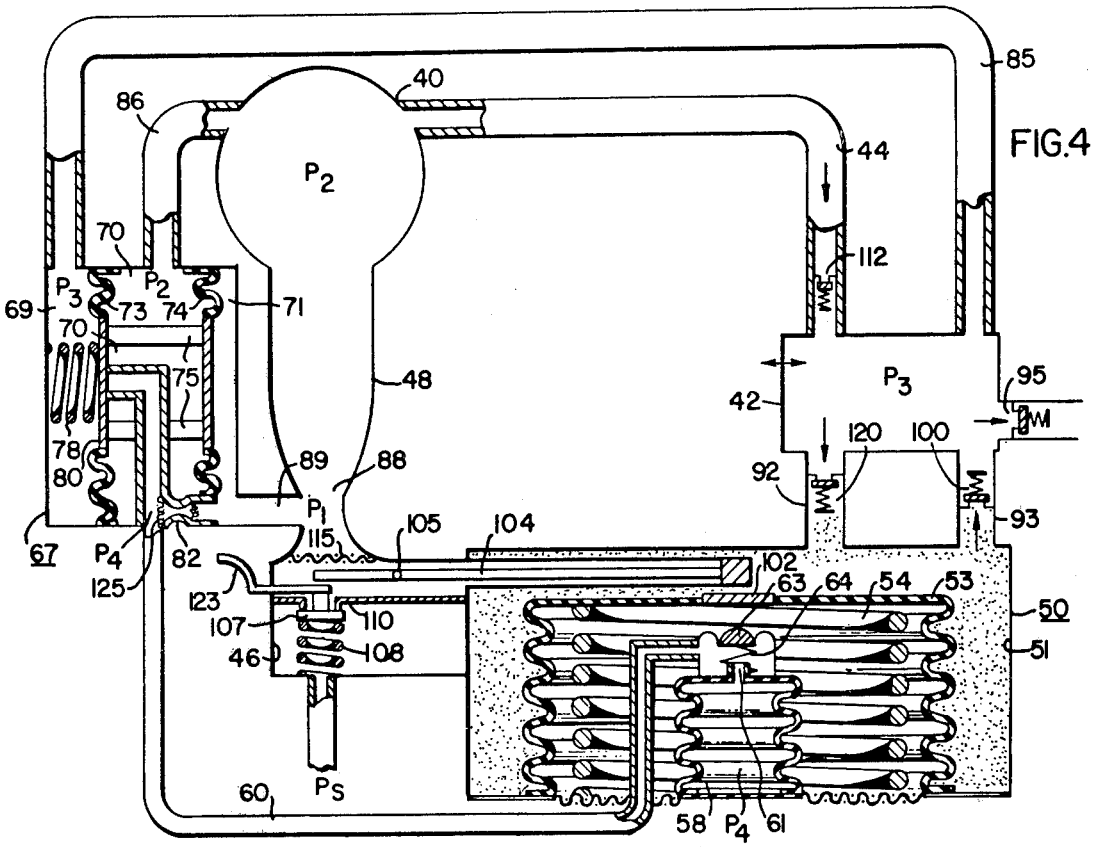
FIG. 4 illustrates in more detail another embodiment of the present invention.

Yet another arrangement for varying the amount of collected exhaled breath in accordance with the user's breathing is illustrated in more detail in FIG. 4. The arrangement utilizes a face or head cover 40 closed to the ambient environment when worn by the user in conjunction with an oral-nasal mask 42 which fits over the nose and mouth of the user and closely conforms to the facial contours. The oral-nasal mask 42 and head cover 40 may be integrated into one unit; however, they are shown separated in FIG. 4 and connected by a valved passageway 44, for ease of explanation.

Breathing gas is supplied on demand to the head cover 40 by means of inhalation demand valve 46 and then through a venturi passageway 48.

The gas collector 50 combines into one unit the previously discussed fixed and variable maximum volumes and includes an outer wall portion 51 and an internal cylindrical collapsible bellows 53 normally urged to its extended position by means of spring 54.

Means for limiting the downward stroke of the bellows 53 is provided and takes the form of a sensor actuator 58 also in the form of a cylindrical collapsible bellows which intercepts and halts the movement of the bellows 53. The sensor actuator 58 is communicative with passageway 60 through aperture 61 as long as moveable button 63 is held away from the aperture by spring 64.

Means for sensing the parameters of an inhalation are provided in the form of sensor 67 divided into three chambers 69, 70 and 71 be means of movable diaphragms 73 and 74 connected together by means of rods 75. Spring 78 normally urges the plate 80 of diaphragm 73 against the opening of passageway 60, and passageway 60 is communicative with chamber 71 through a restricted passage sensor orifice 82.

Figure 5:
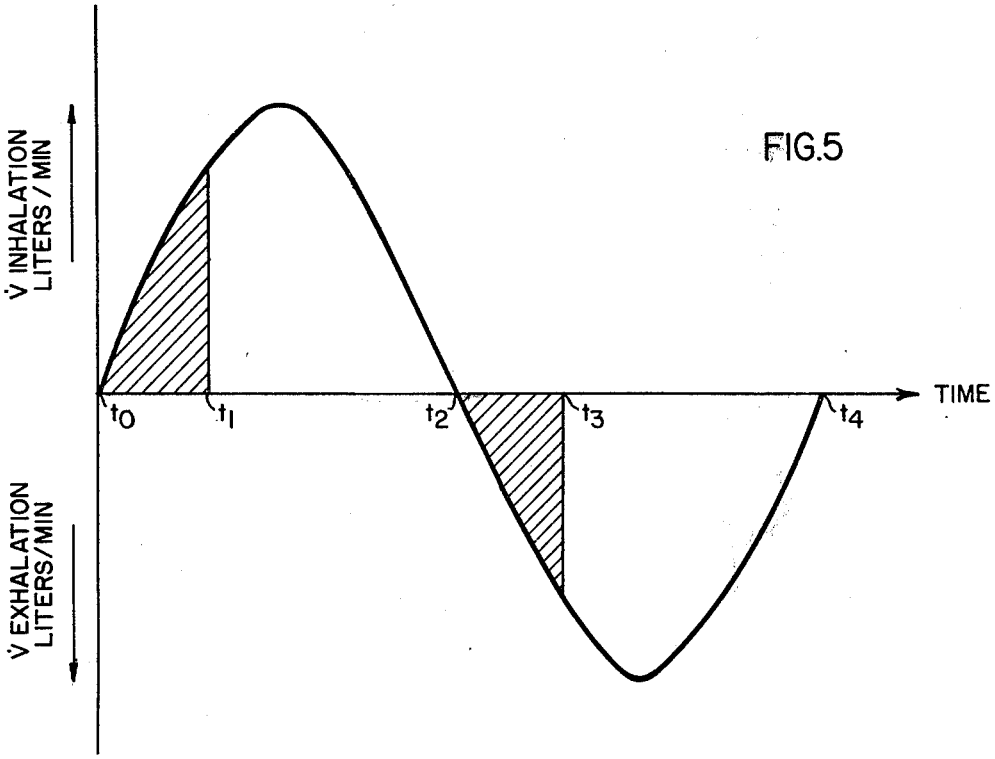
FIG. 5 is a curve illustrating inhalation and exhalation as a function of time.

Chamber 69 is communicative with the oral-nasal mask 42 by way of passageway 85; chamber 70 is communicative with the head cover 40 by means of passageway 86; and chamber 71 is connected to the throat 88 of venturi 48 by means of passageway 89. In addition to communication with the head cover 40 and sensor 67, the oral-nasal mask is communicative with the user's mouth as indicated by the double-ended arrow, is communicative with the gas collector 50 through valved passageways 92 and 93, and is additionally communicative with the ambient medium through relief valve 95. The operation of the apparatus of FIG. 4 will now be explained with additional reference to FIG. 5 illustrating, by an idealized curve, a single inhalation and exhalation as a function of time. Flow, in terms of liters per minute, is plotted on the vertical axis.

At time $t_0$ the user begins to inhale, through spring-loaded one-way valve 100, gas saved in the collector 50 from a previous exhalation. This saved gas is confined to the space between the bellows 53 and wall 51 and is shown stippled. As the user continues to inhale the previously exhaled gas, the pressure within the collector 50 continues to decrease and the bellows 53 moves to its extended position. At $t_1$ the bellows 53 will have moved to a position such that disc 102 on top of the bellows 53 contacts the tilt lever 104. In so moving, the tilt lever 104 pivoted around point 105 depresses valve disc 107 against the action of spring 108 which was forcing it against the valve seat 110. With the demand valve 46 thus opened, breathing gas at a pressure $P_s$ is supplied to the user through venturi 48, head cover 40, passageway 44, and spring-loaded one way valve 112.

A flow straightener, such as a honeycomb section or screen 115, is provided just prior to the converging portion of the venturi in order to provide a more uniform flow. Due to the venturi action, the gas flow causes a pressure reduction at the venturi throat 88 and this pressure $P_1$ is low compared to the pressures in the head cover 40 and oral-nasal mask 42; this pressure $P_1$ is also the pressure in chamber 71 of sensor 67 by virtue of the passageway 89. Similarly, by virtue of passageway 86, the pressure $P_2$ in chamber 70 is the same as the pressure in head cover 40 and the pressure $P_3$ of chamber 69 is the same as the pressure in the oral-nasal mask 42 by virtue of the communication 85. At this time, pressure $P_1$ is lower than pressure $P_2$ or $P_3$ and, consequently, the movable diaphragms 73 and 74 are forced to a position such that the diaphragm plate 80 closes off the opening of passageway 60.

The pressure within the sensor actuator 58 is $P_4$ and, by means of passageway 60, this is the same pressure that appears at the left-hand side of sensor orifice 82. From time $t_1$ to $t_2$ as the user inhales, the pressure drop $P_4$–$P_1$ across the sensor orifice 82 results in a flow rate of gas from the sensor actuator 58 being about proportional to the flow rate through the venturi. Since the flow rates occur over the same period of time, the volume change in the sensor actuator 58 is about proportional to the volume inhaled by the user; and so, at the end of inhalation, the sensor actuator 58 is in a somewhat collapsed position indicative of the inhaled volume. Exhalation commences at time $t_2$, and the exhaled breath starts to fill the collector 50 through spring-loaded one way valve 120. Exhalation continues into the collector from time $t_2$ to $t_3$ at which point the downward stroke of bellows 53 will be stopped by virtue of disc 102 engaging button 63 to force it against the aperture 61. Thus no more gas can be accepted by the collector 50 and the pressure in the oral-nasal mask 42 rises slightly, causing the remainder of the exhalation to be discharged to the ambient medium through the relief valve 95.

The construction and operation of the sensor actuator is such that, if the wearer holds his breath after inhaling, the volume of the sensor actuator 58 and its position will slowly increase because gas will slowly flow through the sensor orifice 82 from the slightly higher pressure $P_2$ in the head cover relative to the pressure $P_4$ in the sensor actuator. (Since there is no flow through the venturi, the pressure $P_1$ will be equal to the pressure $P_2$.) The amount of total possible accumulator volume, accordingly, will become smaller as the wearer holds his breath and this is desirable because the longer the breath is held, the more time there is for $CO_2$ rich gas to mix with the $CO_2$ free gas in the pulmonary passages and less gas should be accumulated for rebreathing in such instance.

At time $t_4$, corresponding to $t_0$ in the cycle, the user begins to inhale the previously collected gas from the collector through valve 100. This results in a slight pressure drop in the oral-nasal mask 42. With $P_3$ slightly less than the pressure $P_2$ in the head cover 40 (and with $P_1$ equal to $P_2$) the movable diaphragms 73 and 74 will move against the action of spring 78 to thereby allow discharge into the sensor actuator 58 from chamber 70 by way of passageway 60 thereby resetting the sensor actuator to its maximum length position for the next inhalation.

If desired, a manual override may be provided to supply the user with gas and this may be accomplished by the provision of a purge lever 123 which, when pushed up, will open the demand valve 46.

In order to insure a clear passageway through sensor orifice 82, screens 125 on either side of the orifice are provided to prevent blockage thereof. With respect to the various spring-loaded valves illustrated, the spring force relationship is such that, of the two valves conducting gas out of the oral-nasal mask 42, valve 120 will open before valve 95; and with respect to the two valves conducting gas into the oral-nasal mask 42, valve 100 will open before valve 112.

With respect to the idealized curve of FIG. 5, it is to be noted that flow rate vs. time is plotted. The area under the curve therefore, is equal to the volume of gas inhaled ($t_0$ to $t_2$) or exhaled ($t_2$ to $t_4$).

The embodiment of the invention illustrated in FIG. 4 is of the type wherein gas is supplied to the user in sequence, that is, first from the gas saver ($t_0$ to $t_1$) and then from the supply ($t_1$ to $t_2$). Flow rate is sensed (and accordingly, volume) only from $t_1$ to $t_2$.

Other arrangements contemplate the simultaneous provision to the user, of saved and supply gas, so that measurement is made of total inhaled gas (e.g. $t_0$ to $t_2$) to control the amount of gas saved on exhalation. Additionally the volume limiting device can also be actuated in response to not only inhaled gas but to exhaled gas, the inhalation flow rate governing the opening of communication to the gas saver and the exhalation governing the closing of such communication.

Figure 6:
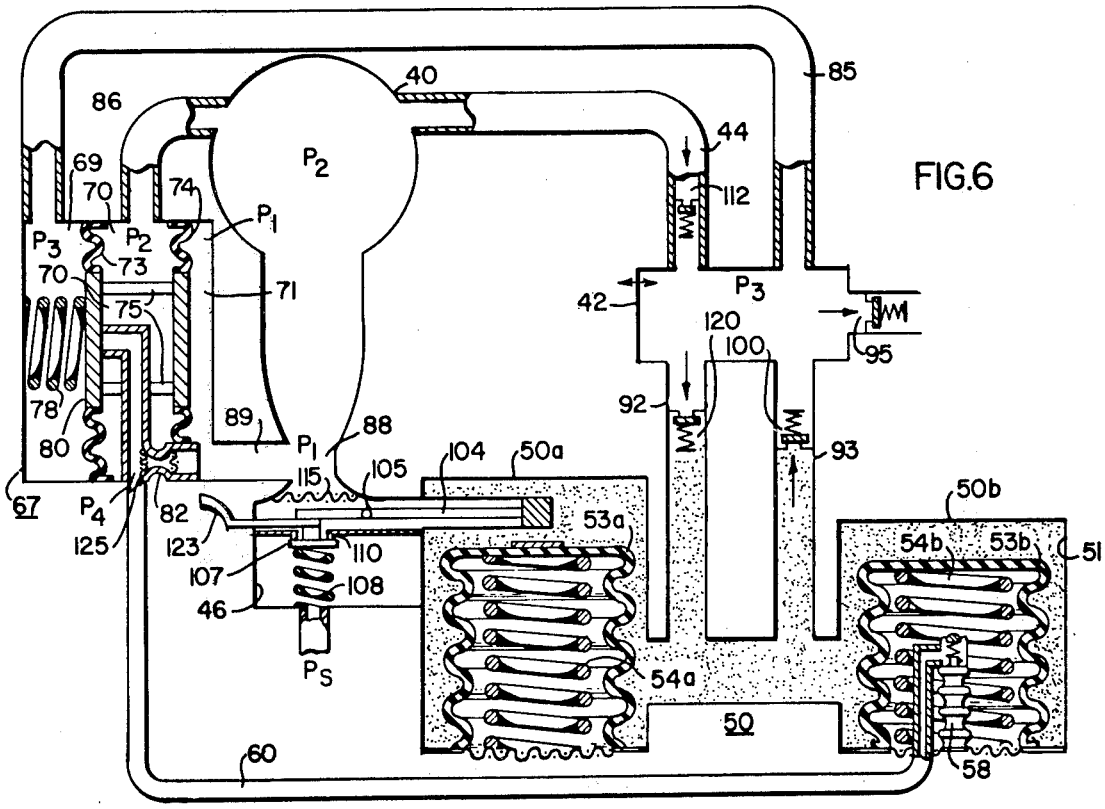
FIG. 6 illustrates a variation of the embodiment of FIG. 4.
Figure 7:
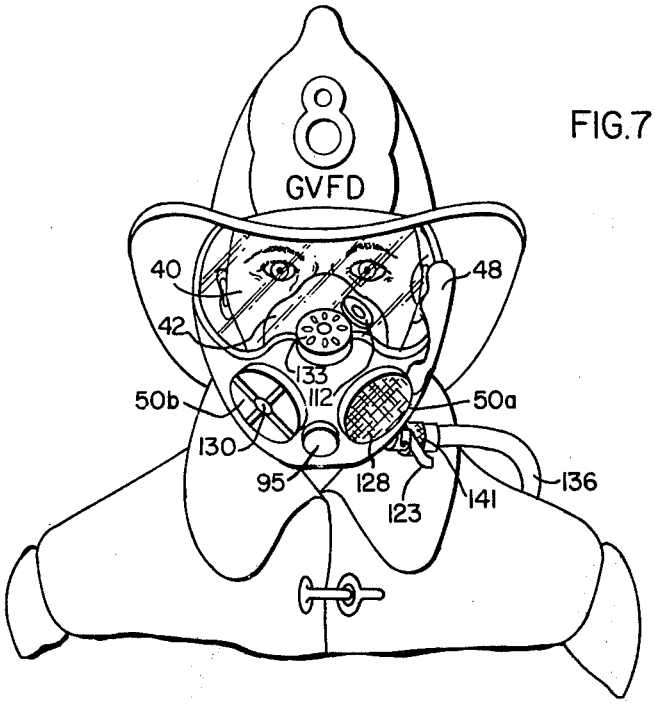
FIG. 7 is a front view of a fire fighter utilizing the apparatus of FIG. 6.
Figure 8:
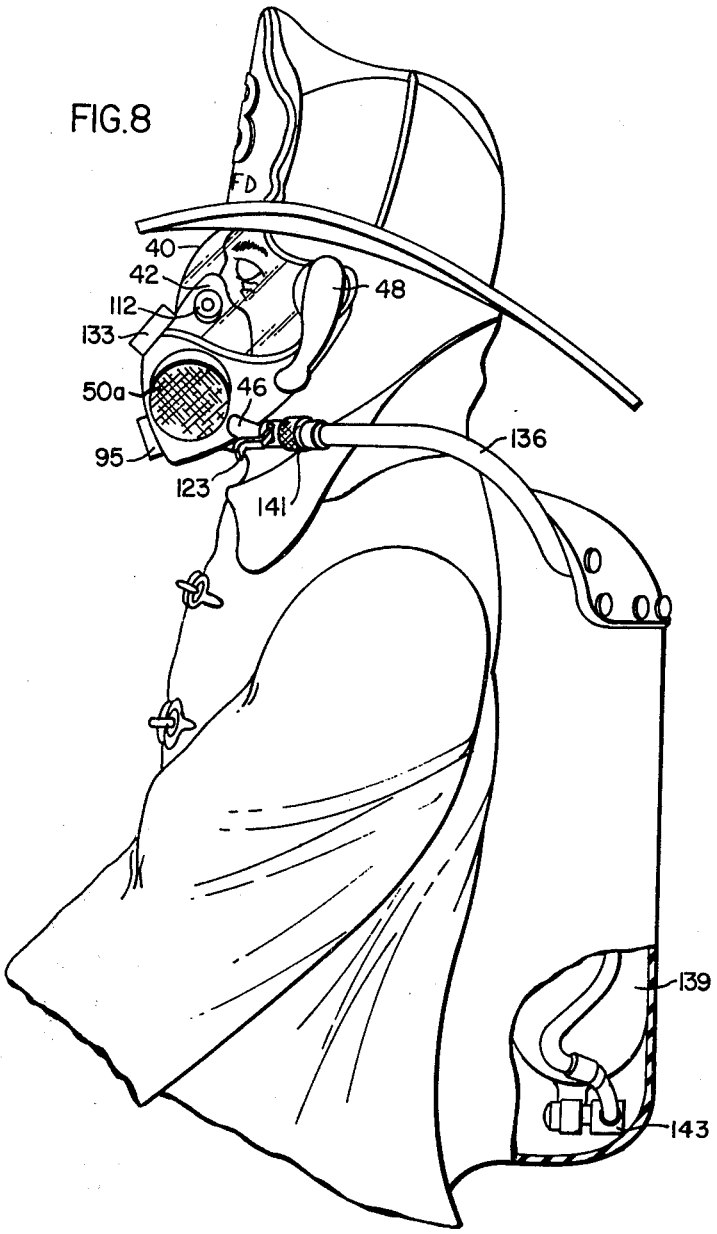
FIG. 8 is a side view of FIG. 7, with portions broken away.

The apparatus herein may be utilized in various fields, such as diving, space or rescue work. For example, the apparatus of FIG. 4 is shown in similar form in FIG. 6 as might be used by a fire fighter as illustrated in FIGS. 7 and 8. The components of FIG. 6 are identical to those described in FIG. 4 and have been given like reference numerals. One exception is the gas collector 50, which has now been divided into a first section **50*a* having a fixed maximum volume and a second section 50*b* having a variable maximum volume. The operation of FIG. 6 is the same as that described in FIG. 4 in that, after the user inhales the previously exhaled gas from collector 50, bellows 53*a* will actuate the tilt lever to cause supply gas to flow. The pressure drop $P_4$–$P_1$ causes a reduction in the volume of sensor actuator 58 in proportion to the inhaled volume. By making the spring force of spring 54*a* less than that of spring 54*b*, as the user exhales into the collector 50, bellows 53*a* will be collapsed first, after which bellows 53*b* will collapse to a position determined by the sensor actuator 58, as previously described. The volumes may be sized such that the first section and associated passageways is approximately equal to the at-rest dead volume while the volume of the second section 50*b*** and its associated passageways is equal to the remaining maximum expected dead volume. In order to accommodate a wide variety of users, the apparatus can be designed with gas collector volumes in, for example, a small, medium and large range. Alternatively, a minimum expected user weight may be determined and the apparatus tailored to that weight, thus adapting to a broad range of individual users and having nearly universal application.

Some components illustrated in FIGS. 7 and 8 have been described with respect to FIGS. 4, 6, and accordingly, have been given like reference numerals. The gas collector sections **50*a* and 50*b* are seen on the fire fighter's mask and section 50*a* has a protective screen 128 and the valve actuator 58 is supported within section 50*b* by means of a spider 130.**

Above the relief valve 95, there is positioned a voice disc 133, whereby the fire fighter may communicate with other personnel.

Demand valve 46 is seen with purge lever 123 and venturi 48, and a gas supply hose 136 is shown in FIG. 8 as being connected to a source of breathing gas, tank 139, by means of a quick-disconnect 141 and a first stage regulator 143.

Many variations of the breathing apparatus are possible depending upon the specific design of components. The flow/volume sensor and the volume limiting devices could be mechanical, electromechanical or fluid-mechanical. The sensor means could be in the form of pressure transducers sensing pressure difference variations to thereby activate a solenoid flow limiting valve to vary the captured exhaled volume.

Figure 9:
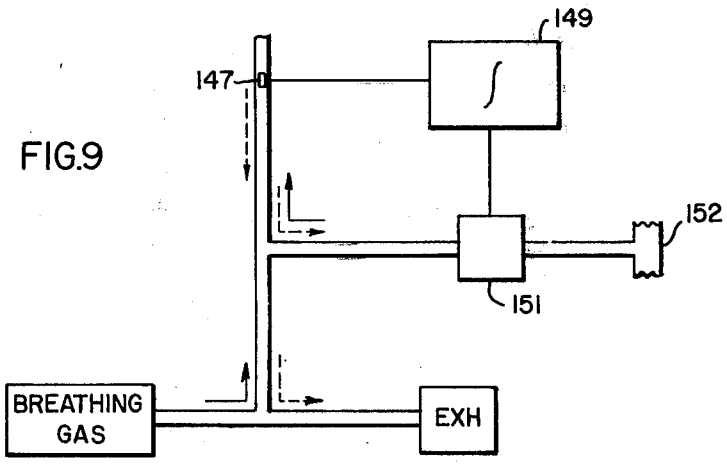
FIG. 9 is a block diagram of another embodiment of the present invention.

Whereas the embodiments thus far described operate with a previous history of the user's breathing, the embodiment illustrated in block diagram form in FIG. 9 operates on a breath-by-breath examination of the exhaled gas. Operation is accomplished by the provision of a sensor 147 operable to provide an output signal indicative of the instantaneous $CO_2$ content of the exhaled breath. The output signal from sensor 147 is received by electronic circuit 149 to activate a valve 151 to a closed position, thus shutting off exhaled gas flow to gas collector 152. Operation can be such that the valve will be shut off when the output of sensor 147 indicates that alveolar gas is present, or alternatively, the output of sensor 147 can be integrated such that the electronic circuit 149 will shut the valve 151 when a total accumulated $CO_2$ content reaches a predetermined, dangerous level.

We claim:

1. Breathing apparatus comprising:

a. means for providing a user with a gas to be breathed;

b. a gas saver means for the capture of the initial portion of the user's exhaled breath;

c. carbon dioxide sensing means for sensing the carbon dioxide content of the user's exhaled breath and operable to provide an output signal indicative thereof;

d. means responsive to said output signal for preventing further capture of said exhaled breath during the time it is being exhaled, when the carbon dioxide content thereof attains a predetermined level;

e. means for discharging said exhaled breath to atmosphere after said predetermined level has been attained.

2. Apparatus according to claim 1 wherein said means responsive to said output signal includes a. valve means in communication with said gas saver means and being operable upon activation to a closed position to shut off exhaled breath flow to said gas saver means.

3. Apparatus according to claim 2 which further includes a. an electronic circuit means connected to receive said output signal of said carbon dioxide sensing means and operable to provide an activation signal to close said valve means when alveolar gas is sensed by said sensing means.

4. Apparatus according to claim 3 which further includes a. an electronic circuit means connected to receive said output signal of said carbon dioxide sensing means and operable to provide an activation signal to close said valve means when a total accumulated carbon dioxide content reaches a predetermined dangerous level.

* * * * *